United States Patent [19]

Ruess

[11] 4,022,467

[45] May 10, 1977

[54] TENNIS PRACTICE DEVICE

[76] Inventor: Alfred P. Ruess, 1733 Ensley Ave., Los Angeles, Calif. 90024

[22] Filed: Sept. 13, 1974

[21] Appl. No.: 505,613

[52] U.S. Cl. ..... 273/29 A; 273/DIG. 6

[51] Int. Cl.[2] ..... A63B 61/00

[58] Field of Search ..... 272/77, 78; 240/6.42; 84/477; 46/47, 51; D34/5 BC; 273/80 R, 80 B, 29 A, DIG. 6, 185 D, 197 R, 197 A, 198, 106 R

[56] References Cited

UNITED STATES PATENTS

| | | | |
|---|---|---|---|
| 3,114,546 | 12/1963 | Verseghy | 272/78 |
| 3,114,550 | 12/1963 | Hughes | 273/106 R |
| 3,528,659 | 9/1970 | Benham | 273/106 R X |
| 3,596,921 | 8/1971 | Bruckl | 273/80 R |
| 3,861,683 | 1/1975 | Henry | 273/DIG. 6 |

FOREIGN PATENTS OR APPLICATIONS

| | | | |
|---|---|---|---|
| 773,162 | 4/1957 | United Kingdom | 273/DIG. 6 |

*Primary Examiner*—Anton O. Oechsle
*Assistant Examiner*—T. Brown
*Attorney, Agent, or Firm*—Blakely, Sokoloff, Taylor & Zafman

[57] ABSTRACT

Various embodiments of a handheld tennis practice device are disclosed. The device generally comprises a flexible L-shaped rod or tube having a ball affixed at one or both ends thereof. Means which enable the user to securely grip the device are also disclosed, as well as improved means for securing the ball to the end of the rod or tube. To be more specific, a first gripping member or handle is disposed at the outer end of one leg of the L-shaped device and a knurled region for gripping by a user is disposed on the other leg of the L-shaped device in the vicinity of the juncture of the legs of the device. The device is designed to enable the user to practice various strokes involved in racquet sports. It is particularly suited for the practice of tennis strokes.

7 Claims, 17 Drawing Figures

TENNIS PRACTICE DEVICE

BACKGROUND OF THE INVENTION

1. Field of the Invention

This invention relates to sports practice equipment, more particularly, to a handheld tennis practice device.

2. Prior Art

Tennis is a popular sport which appeals to people of all ages. Interest in it in the United States has reached an all time high. While great proficiency is not a prerequisite to enjoying tennis, proper strokes and form can enhance one's enjoyment and decrease frustration. Proper strokes and form require time and practice to acquire. Because of the recent increased interest in this sport, a great number of people are attempting to learn proper tennis techniques in a variety of ways. Some people take private or group tennis lessons from an instructor. Others attend tennis clinics and camps. Many others attempt to learn from the myriad of illustrated books on the subject. In all cases, however, one must put into practice what he has learned, whether from lessons, instruction book or otherwise.

Typically, practicing what one has learned requires an opponent and a tennis court. To circumvent the need for another person and a court whenever one desires to practice various tennis strokes, many devices are known in prior art which enable the user to practice by himself in the confines of a room or backyard. However, these prior art tennis practice devices suffer from a number of significant limitations and shortcomings. For example, one prior art device consists of a ball mounted at the end of a rubber string. The other end of the string is secured in a weighted base. The user grasps the ball, throws it into the air and swings the tennis racquet at the ball. A first shortcoming of this device is that it requires a relatively large area for use. Secondly, the user has no means to control the ball once it is hit. Because the elasticity of the string causes the ball to return erractically in speed and direction, the user may be physically injured if struck by the ball. Moreover, others may be struck by the ball as it snaps back in this erractic manner. Finally, no satisfactory system has been devised to prevent the rubber string from breaking loose from the ball after a relatively short period of time (e.g. a few months), an occurrence which renders the device useless.

Another device known in the prior art consists of a ball mounted at the end of a shaft, the latter being secured to an immovable base by a springed hinge. The user stands on or near the base and swings the racquet toward the ball. This device has several severe limitations. In the first place, it is not portable because of the heavy base required. Secondly, it is limited in the length adjustments which are possible, and, therefore, as to the types of strokes for which it can be used. For example, the shaft would have to be seven or eight feet in length in order to enable one to practice service and overhead strokes, while 3 or 4 feet for normal forehand and backhand strokes. Thus, the typical lengths used preclude practice of the service and the overhead stroke. Lastly, this type of device is susceptible to great damage by strokes that hit the shaft rather than the ball, as well as by strokes that, because of their direction of motion, greatly stress the hinging means; e.g., strokes such as mis-hits, spins and slice shots.

Another prior art device consists of a ball suspended on a string which is mounted between a ceiling and a floor. The user adjusts the string to a desired position between ceiling and floor and hits the ball with the racquet. This device has the disadvantages of needing firm anchorages in the floor and ceiling and, thus, not being readily useable outdoors. More importantly, it prevents the natural follow through which is essential to good tennis technique. Finally, the user must also readjust the string every time a new ball position is desired.

One further device known in the prior art consists of a ball mounted at the end of a curved flexible rod. The rod is attached to a post and the post is mounted in a heavy base. This device is not portable and the kinds of strokes that may be practiced with it are limited. For example, the height of the post is typically not great enough (seven or eight feet) to enable proper service or overhead techniques to be practiced. Also, this device is susceptible to being damaged by strokes that hit the rod instead of, or in addition to, the ball.

The present invention overcomes the foregoing limitating and shortcomings of the prior art. It provides a lightweight, compact means for practicing most strokes, including (i) the forehand drive, slice, sidespin, volley and half volley; (ii) the backhand drive, slice, sidespin, volley, half volley; and (iii) the overhead and service. The present invention does not require a large area for use. Moreover, it is portable, adapted for use in a small area, both indoors and outdoors, and conveniently stored when not being used. It has the advantage of not requiring any special installation or set-up, especially one which is more or less permanent.

The present invention is more durable than many of the devices known in the prior art. It has no elastic strings to break nor is it prone to being damaged if hit inadvertently in the wrong way by the user. Furthermore, the device according to this invention is safe. It does not involve any fast flying and uncontrolled ball. In addition, means for preventing the ball from flying from the device in the event of breakage is also contemplated and disclosed by this invention.

Most importantly, the present invention is effective in improving the strokes of tennis players. Its use encourages the proper execution of each stroke, as more fully discussed hereinbelow. Its use also encourages the beneficial habit of using the free hand and arm for balance while stroking the ball. The invented device enables one to sense when a stroke is imperfect, not only with the hand holding the racquet but also with the hand holding the device. Finally, use of this invention helps develop the habit of concentrating one's attention, and keeping one's eyes, on the ball.

BRIEF SUMMARY OF THE INVENTION

A first embodiment of the present invention is comprised of a member having first and second arms substantially at right angles to one another. The member is preferably made of a flexible plastic such as an integral nylon rod or tube bent at a right angle. A suitable handle is either affixed to or integral with the end of the first arm. A ball is secured to the end of the second arm. To enhance the flexibility of the arm bearing the ball, it is preferred that it be tapered down from the end near the center of the device to the end with the ball. The end of the second arm near the center also has a knurled region for gripping. For the practice of backhand related strokes, the user grips the handle in one hand and holds his racquet in the other. The ball is positioned and the strokes made as described more fully hereinbelow. For the practice or forehand related, overhead and service strokes, the user grips the knurled region of the second arm instead of the handle.

Variations of this basic embodiment include (i) a device where the first and second arms are not integral but joined to one another, the diameter of the second arm being smaller than that of the first; (ii) a device where the first and second arms are made of a flexible metal, including springing means, and are disengageably fixed to one another; (iii) a device comprised of a straight rod having a ball and handle affixed thereto; and (iv) a device comprising a non-planar U-shaped member having a ball affixed at each of its ends.

The present invention also includes an improved means for securing the ball to the end of the rod so as to increase the life of the ball and the security of the juncture. Further, this invention teaches the use of wound tape or a suitable sheath on the arm bearing the ball to prevent its flying off and injuring someone in the event the arm breaks during use. Thus, it is a principal object of this invention to provide an inexpensive, portable device for practicing a wide variety of tennis and other strokes with highly beneficial results.

It is another principal object of this invention to provide a practice device which is durable, safe, useable in a small area, both indoors and outdoors, and which does not require any costly and/or permanent installation.

Other objects, novel features, and advantages of the present invention will become apparent upon making reference to the following detailed description and the accompanying drawings. The description and the drawings will also further disclose the characteristics of this invention, both as to its structure and its mode of operation. Although preferred embodiments of the invention are described hereinbelow, and shown in the accompanying drawing, it is expressly understood that the descriptions and drawings thereof are for the purpose of illustration only and do not limit the scope of this invention.

DETAILED DESCRIPTION OF THE INVENTION

A first embodiment 10 of the invention, adapted for practicing all tennis strokes, is now described in detail with reference to FIGS. 1 – 3. Device 10 is comprised of (i) a rod or tube 12 of flexible material, preferably nylon, curved gradually in the vicinity of its center 12*a* so as to form an approximate right angle, and (ii) a ball 14 affixed to one end thereof. The arms of the right angle formed by rod or tube 12 are designated for reference as arms 12*b* and 12*c* respectively. In this embodiment arms 12*b* and 12*c* are integral with curved portion 12*c;* i.e., rod or tube 12 is made from a single piece of material.

Figure 1A:
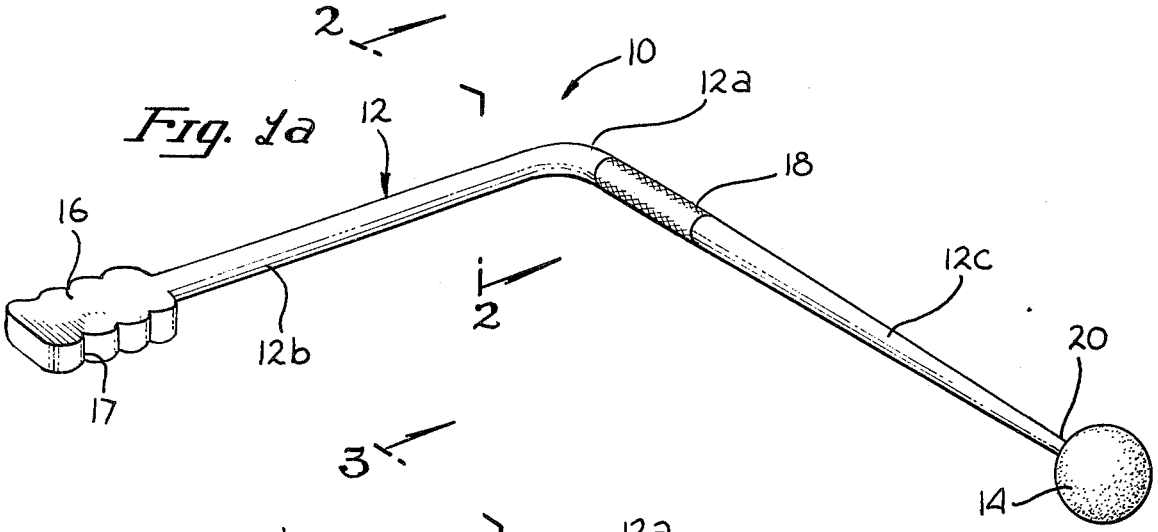
FIG. 1*a* is a front perspective view of a first practice device made in accordance with the present invention.

Arm 12*b* is used primarily for practicing the backhand stroke. A handle 16 is either integral to or affixed to the outer end of arm 12*b* to enable the user to hold the device 10 without it slipping or rotating in his hand. A preferred handle 16, shown in FIG. 1*a*, is a narrow, substantially rectangular member having grooves 17 adapted to receive the fingers of the user's hands. The plane of handle 16 is substantially co-planar with the plane of the arms 12*b* and 12*c*. Of course, other conventional handle or gripping means may also be used.

Arm 12*c* is held for practicing the forehand, service and most other strokes. It is knurled for gripping at its upper end 18 just beyond curved portion 12*a* of rod or tube 12, as shown in FIG. 1*a*. Ball 14 is affixed to the end 20 of arm 12*c* in the manner described hereinbelow.

Since arm 12*c* has the ball 14 affixed thereto, it must have sufficient flexibility (i) to enable the ball to spring off the racquet as the stroke is made, and (ii) to absorb the force or shock of the stroke which would otherwise be transmitted to the user's arm holding the device 10. In order to increase the flexibility of arm 12*c*, it is preferred that it be tapered from the vicinity of knurled region 18 down to the end 20. The required diameter of arm 12*b* and curved portion 12*a* is a function of the strength and flexibility of the material from which rod or tube 12 is made. The diameter of curved portion 12*a* is particularly important in that this portion of rod or tube 12 must bear the stresses caused by the practice strokes, without having as much stress-relieving flexibility as is permissible for tapered arm 12*c*. The optimum diameter of rod or tube 12, up to region 18 where the taper begins, can readily be determined by persons skilled in the art. When nylon rods or tubes are used, the preferred diameters of arm 12*b* and curved portion 12*a* are in the range one-half to three-fourths inch, and the diameter of arm 12*c* at end 20 is about one-fourth inch.

The length of arm 12*b* from end of handle 16 to the center of curved portion 12*a* is preferably about 20 inches, so as to accommodate a broad range of users of varying ages and sizes. The length of arm 12*c* from the center of curved portion 12*a* to the center of the ball 14 is preferably about 23 inches. This dimension is approximately the same as the distance from the end of the handle of a conventional tennis racquet to the center of its head. This choice of length enables the user, while gripping the device 10 at region 18 in one hand, to meet the ball 14 while stroking with the other hand.

Figure 1B:
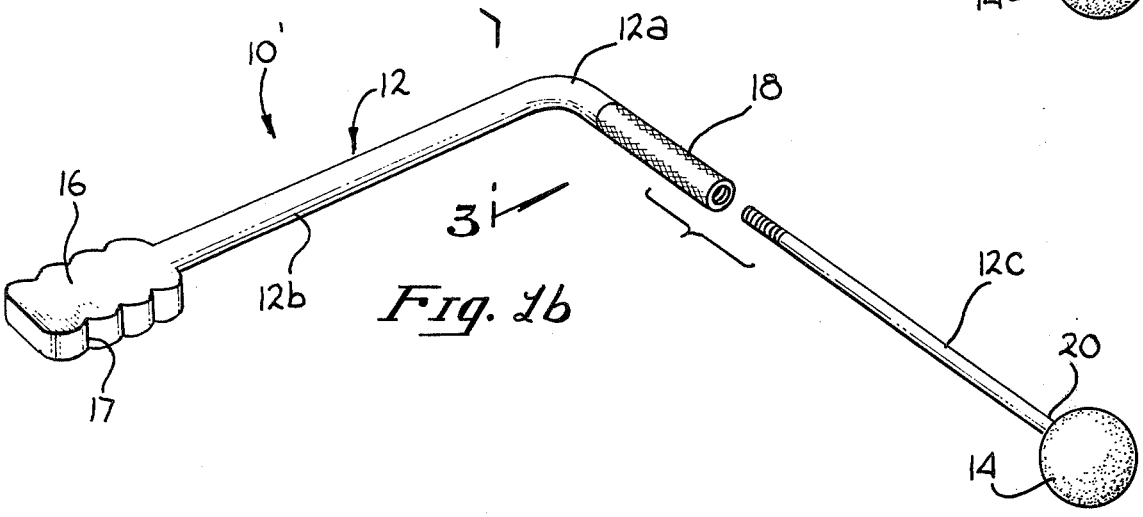
FIG. 1*b* is a front perspective view of a variation of the device of FIG. 1*a*.

A variation 10′ of device 10 is shown in FIG. 1*b*. Like elements described with respect to device 10 are designated by the same numerical designation with respect to device 10′ and are not described again. In device 10′, arm 12*c* is not integral with curved portion 12*a*, but, rather, is a separate rod or tube joined to curved portion 12*a*. The preferred diameter of arm 12*c* is about one quarter inch. No taper of arm 12*c* is required, there being a discontinuity in the diameter of the device 10′ at the juncture of arm 12*c* and curved portion 12*a*. Since the diameter of curved portion 12*a* is greater than that of arm 12*c*, one suitable means for joining them is to threadably screw arm 12*c* into curved portion 12*a*. Other suitable means for joining arm 12*c* to curved portion 12*a*, with sufficient strength to withstand the stresses of the practice strokes, can readily be determined by persons skilled in the art using known techniques and means.

Figure 2A:
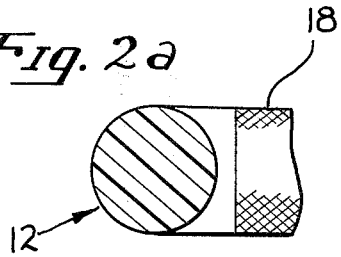
FIG. 2*a* is a cross-sectional view of an arm of the device of FIG. 1*a* taken along lines 2 — 2 thereof, where said arm is comprised of a circular rod.
Figure 2B:
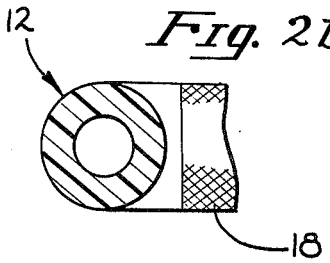
FIG. 2*b* is a cross-sectional view of an arm of the device of FIG. 1*a* taken along lines 2 — 2 thereof, where said arm is comprised of a circular tube.
Figure 3A:
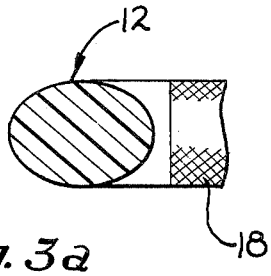
FIG. 3*a* is a cross-sectional view of an arm of the device of FIG. 1*b* taken along lines 3 — 3 thereof, where said arm is comprised of an elliptical rod.
Figure 3B:
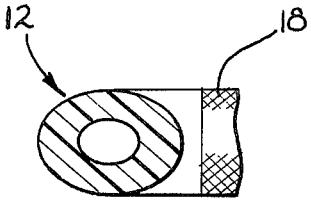
FIG. 3*b* is a cross-sectional view of an arm of the device of FIG. 1*b* taken along lines 3 — 3 thereof, where said arm is comprised of an elliptical tube.

It should be understood that the invention embodied in devices 10 and 10′ are not necessarily limited to rod or tubes 12 having circular cross-sections. A rod or tube having an elliptical cross-section is likewise contemplated by the present invention for the purpose of varying the degree and directionality of the flexibility of arm 12*b* of either embodiment 10 or 10′. The particular dimensions of the major and minor axes of such an elliptical rod or tube, and their respective orientation, are a function of the strength and flexibility of the material used and the desired effect upon the flexibility of arm 12*b*. The specific parameters are a matter of design for those skilled in the art. To illustrate this feature of the present invention, arm 12*b* of device 10, is shown in FIGS. 2*a* and 2*b* as a circular rod 12 and a circular tube 12 respectively; while, arm 12*b* of device 10′ is shown in FIGS. 3*a* and 3*b* as an elliptical rod 12 and an elliptical tube 12 respectively.

Figure 4:
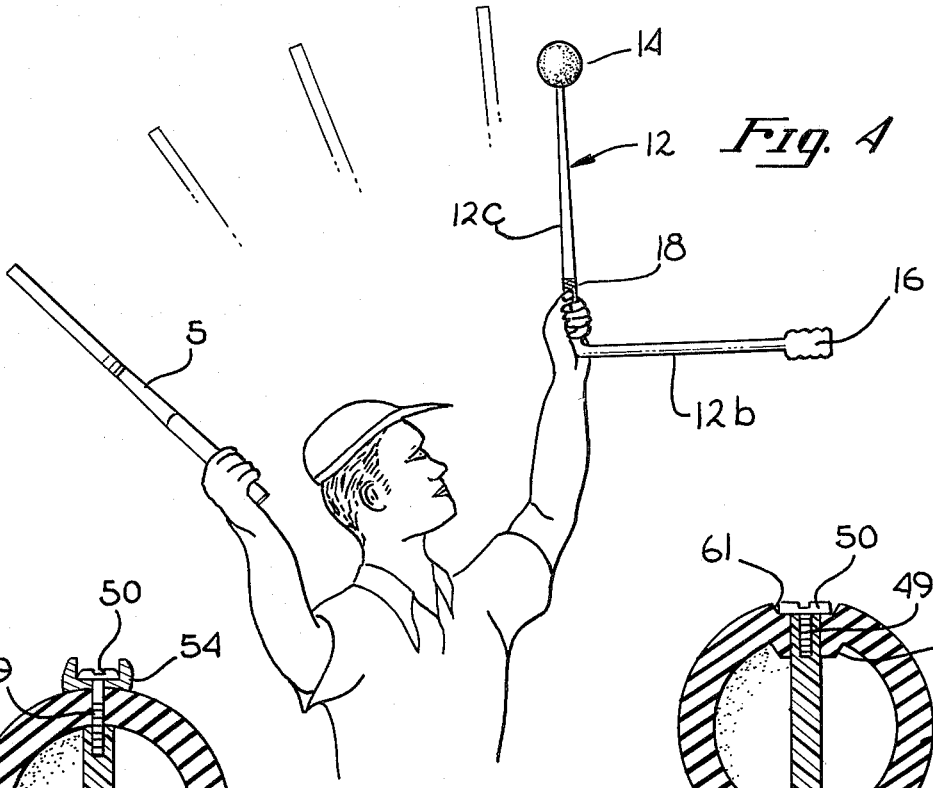
FIG. 4 is a front perspective view of a person using the device of FIG. 1 to practice a service stroke.

This invention also contemplates the fabrication of devices 10 and 10′ from a lightweight metal having sufficient strength. In such embodiments (not shown) arms equivalent to 12*b* and 12*c* are affixed to one another at approximate right angles by conventional joining means, thereby eliminating the need for a curved portion, such as 12*a*. In order to impart the necessary flexibility to the equivalent of arm 12*c*, springing means are disposed at one or more appropriate locations along the length thereof. Moreover, springing means are also preferred in the equivalent to arm 12*b*, close to its juncture with the other arm (12*c*) in order to provide some stress-relieving flexibility to the joint. A further feature of the foregoing embodiment contemplated by this invention is to utilize disengageable joining means for joining the arms. Thus, when the device is to be used for practicing the forehand, service, and overhead strokes, the equivalent of arm 12*c* can be utilized separately and apart from the equivalent of arm 12*b*. As in the case of embodiments 10 and 10′ suitable knurling or gripping means is provided to enhance the user's grip The manner of use of devices 10 (and 10′) is now described with reference to FIGS. 4 and 5. The user grips a tennis racquet 5 in one hand and the device 10 in the other. For use in practicing the forehand, service, or overhead strokes, device 10 is gripped at knurled region 18 of arm 12*c* just after curved portion 12*a*. For the foregoing strokes, curved portion 12*a* and arm 12*b* are not utilized, and arm 12*b* is simply extended away from the body of the user, as shown in FIG. 4. The user then extends the arm holding the device 10 to a position which places the ball 14 in the approximate position at which impact would occur during the proper execution of the particular stroke being practiced. In FIG. 4, the user is shown practicing a service stroke. The device 10 is being held up by the user's left hand so as to place the ball 14 over his head and in front at about the position of impact during a service stroke. After the abovedescribed position of the user's body and arms is assumed, the user executes the stroke, concentrating on his form and movement while keeping his eyes on the ball 14. As the head of the racquet 5 swings through the ball 14, the arm and hand holding the racquet 5, as well as the user's body, flex in the direction of the swing. For a forehand stroke, the device 10 is held so that arm 12*c* thereof extends out in front of the user to place the ball 14 in the approximate position at which impact would occur during a properly executed forehand stroke. The ball 14 can be placed high or low to simulate high or low forehand shots.

Figure 5:
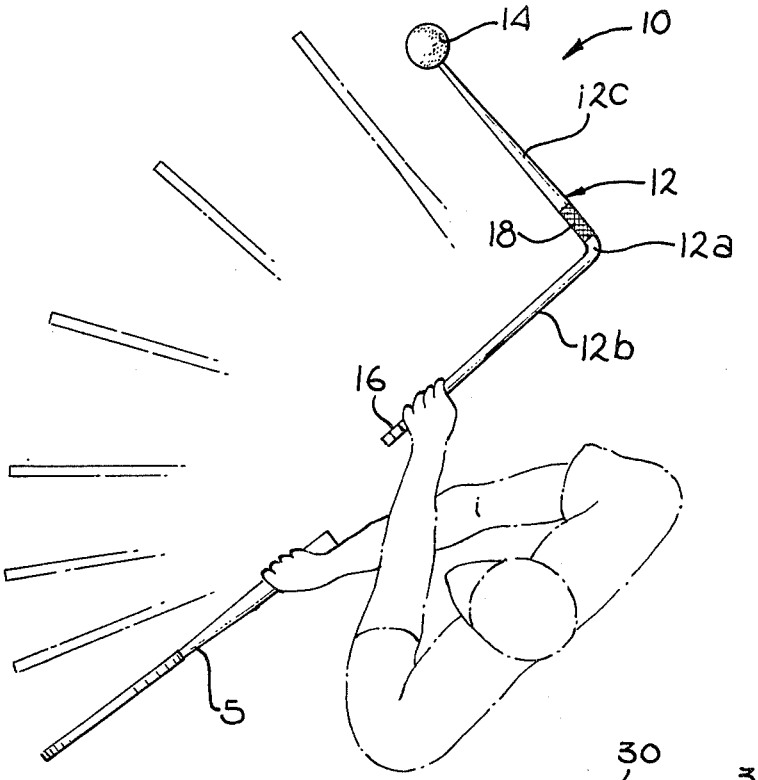
FIG. 5 is a top plan view of a person using the device of FIG. 1 to practice a backhand stroke.

For practicing the backhand stroke, the user grips device 10 in his free hand by the handle 16. In his other hand, of course, he holds the racquet 5, as shown in FIG. 5. The user holds the device 10 in that position which places the ball 14 in the approximate position at which impact would occur during a properly executed backhand stroke. The curved portion 12*a* of device 10 is extended forward of the user, so that arm 12*b* is approximately parallel to the user's shoulders. Significantly, because of the dimension of the device 10, the position of the user's arm and hand holding the racquet 5, necessary to correctly position the ball 14, is also the proper position for the hand and arm during a backhand stroke. The user then extends the racquet 5 back preparatory to executing the backhand stroke. The stroke is then executed, while the user concentrates on his form. He rotates and moves forward with the stroke, allowing the racquet head to swing through the ball 14.

The proper use of device 10 for other strokes can be readily learned by simple experimentation. The key to its proper use is (i) to place the ball in the correct impact position; (ii) to keep one's eyes on the ball; and (iii) to practice the stroke as though one had perfect timing and and could consistently strike the ball at the optimum time and position. In addition to the development of proper form, use of the present invention encourages mental concentration, the keeping of one's eyes on the ball and the proper shift of weight necessary for power and timing. The latter is a result of the stroking force incident to use of the invented device 10, a force which causes the arm holding the device and the user's torso to move forward.

Further embodiments 30 of the present invention, adapted for practicing the forehand, service and overhand strokes, are now described with reference to FIGS. 5 and 6. The device 30 is comprised of a straight rod or tube 32, preferably nylon, and a tennis ball 14 affixed to the rod or tube 32 at one end thereof. A conventional handle 36 is affixed to the other end of rod or tube 32 for the purpose of providing a secure means for gripping the device 30. The handle 36 must be affixed very tightly to the rod or tube 32 in order to prevent it from vibrating when the device 30 is subject to the impact of practice strokes.

The optimum diameter of the rod or tube 30 is again a function of the strength and flexibility of the material used for the rod or tubing 32. When nylon is used, a preferred diameter is about one quarter inch. In this embodiment, the rod or tubing 32 may be circular or elliptical in cross-section. The length of the rod or tube 32 is about 23 inches, typically the length of a conventional tennis racquet from the end of its handle to the center of its head.

Device 30 is used principally to practice forehand, service, and overhead strokes. Its use for these strokes is the same as that described above with respect to device 10. Device 30 has an advantage over device 10 for these strokes in that there is no extra arm, such as arm 12*b*, to be carried and handled. On the other hand, however, because of the lack of an arm 12*b*, device 30 is not suitable for the practice of the backhand stroke.

Figure 6A:
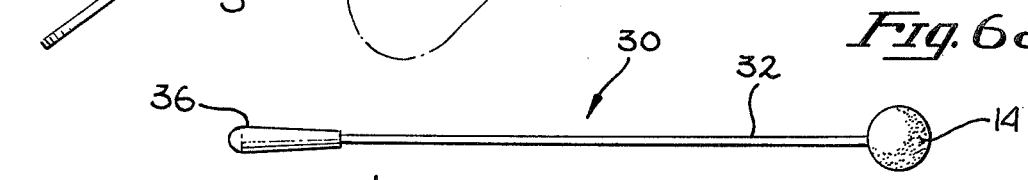
FIG. 6*a* is a front plan view of a second practice device made in accordance with the present invention.
Figure 6B:
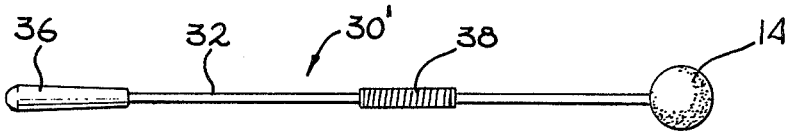
FIG. 6*b* is a front plan view of a first variation of the device of FIG. 6*a*.
Figure 6C:
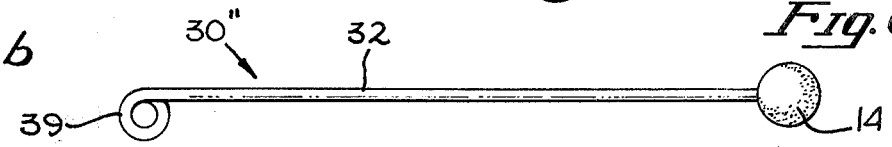
FIG. 6*c* is a front plan view of a second variation of the device of FIG. 6*a*.

Two variations of device 30 are shown in FIGS. 6*a* and 6*b*. Device 30' (FIG. 6*a*) is the same as device 30 except the rod or tube 32 is made of a suitably flexible and lightweight metal having sufficient strength for the application, such as, for example, aluminum. In order to increase the flexibility of rod or tube 32, a springing means 38 may be incorporated therein by any conventional method known for joining metal parts. Device 30'' (FIG. 6*b*) is the same as device 30 except that the means provided for gripping it is a rolled end 39 of rod or tube 32, instead of handle 36.

Figure 7A:
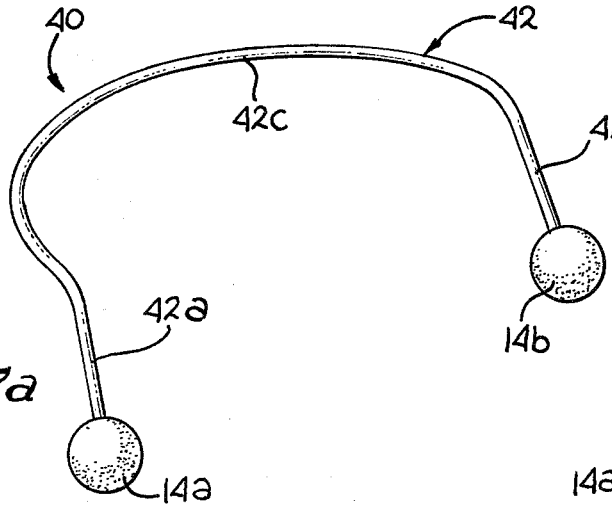
FIG. 7*a* is a front perspective view of a third device made in accordance with the present invention.
Figure 7B:
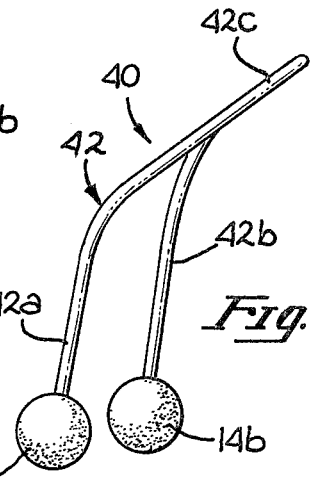
FIG. 7*b* is a side perspective view of the device of FIG. 7*a*.

A still further embodiment 40 of the present invention, adapted for use in practicing the backhand storke, is described with reference to FIGS. 7*a* and 7*b*. It is comprised of (i) a generally non-planar U-shaped rod or tube 42 and (ii) a pair of tennis balls 14*a* and 14*b* affixed at opposite ends thereof. The balls 14*a* and 14*b* and the end portions 42*a* and 14*b* of the rod or tube 42 are substantially planar, while the curved portion 42*c* of the rod or tube 42; i.e., the bottom of the U, is in a different plane therefrom.

The distance between the centers of balls 14*a* and 14*b* is typically about 20 inches; arms 42*a* and 42*b* are about 6 inches; and the circumferential length of cruved portion 42*c* is about 21 inches. These dimensions are such as to place the ball 14 which is to be hit in the proper position for the backhand stroke. Rod or tube 42 is preferably made of a flexible metal or plastic, such as nylon, having a diameter which imparts sufficient strength and flexibility to the device 40. Its cross-section may be either circular or elliptical.

In use, the device 40 is held so that the force of striking the ball 14 has the tendency to open or widen the U. Thus, a right-handed player would hold the device 40 in his left hand by holding ball 14*b*, while a left-handed player would hold ball 14*a* in his right hand. In this way, during use, the bottom of the U is held in front of, and in approximate alignment with, the user's body, so that the U tends to be flexed open or widened by the force of the practice strokes. The use of device 40 is substantially the same as that described above with respect to device 10, and illustrated in FIG. 5.

Figure 8:
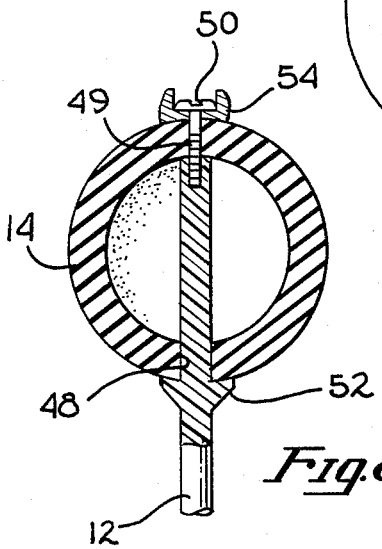
FIG. 8 is a cross-sectional close-up view showing a means for affixing a ball to a rod in accordance with this invention.
Figure 9:
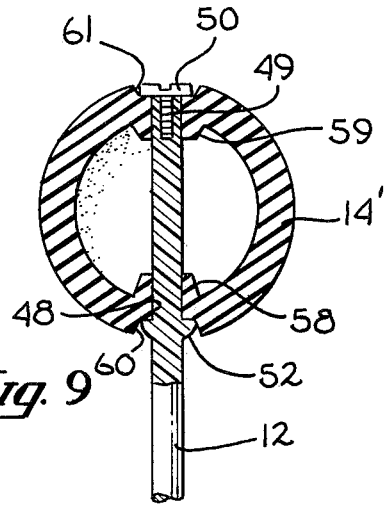
FIG. 9 is a cross-sectional close-up view showing a means for affixing a specially reinforced ball to a rod in accordance with this invention.

With reference to FIG. 8 and 9, two preferred means for affixing the ball 14 to the end of the rod or tube 12 is described. The same means for affixing the ball is also applicable with respect to rods or tubes 32 and 42 of embodiments 30 and 40, respectively, described hereinabove. The first means described relates to the use of a conventional tennis ball for ball 14 of this invention. As shown in FIG. 8, a hole 48, adapted to receive the rod or tube 12, is made through the ball 14. A hole 49, adapted to receive a conventional fastener 50 of about 3/32 inches in diameter, is made through the ball 14 diametrically opposite the position of the first hole 48. In addition, rod or tube 12 is fitted with, or molded so as to have, a flange 52 near its end, this flange 52 being adapted to engage the outside surface of the ball 14. The end of rod or tube 12 is inserted into the ball 14 through the hole 48 up to the engaging surface of the flange 52. Fastener 50 is passed through a protective covering means 54 and hole 49 fastened to the end of rod or tube 12. Protective covering means 54 may be any conventional fastener head protective washer. Its purpose is to keep the head of the fastener 50 from damaging the strings of the tennis racquet 5 as it strikes the ball 14.

A second means for affixing the ball 14 to the rod or tube 12 is shown in FIG. 9. For this embodiment, a specially constructed ball 14' is required, as described below. However, the manufacture of such a ball is feasible by known methods in the ball manufacturing industry. Elements corresponding to those heretofore described with respect to affixing a conventional ball 14 to the rod or tube 12 will be designated by the same numerals.

With reference to FIG. 9, special ball 14', having additional internal reinforcing material 58 and 59 integral with the interior surface of the ball 14', is shown. Holes are made through the ball 14' through reinforcing materials 58 and 59 respectively. Thus, the ball 14' is reinforced in the vicinity of its greatest vulnerability to damage, namely near holes 48 and 49. Moreover, because of the additional material 48 and 49, there is sufficient strength to permit recesses or countersinks 60 and 61 to be made in the outer surface of the ball 14 axially with the holes 48 and 49 respectively. By virtue of recess 61, the head of fastener 50 does not extend above the outer surface of the ball 14', thus eliminating the need for a fastener head protective means 54. Recess 60 is adapted to receive the flange 52.

The present invention also contemplates the use of a solid core ball for the practice ball 14, as well as the hollow core balls shown in FIGS. 8 and 9. The means for affixing such a ball to a rod or tube would be the same as described with reference to hollow core ball. Such a solid core ball would, of course, permit the use of recesses 60 and 61 as shown in FIG. 9.

Figure 10:
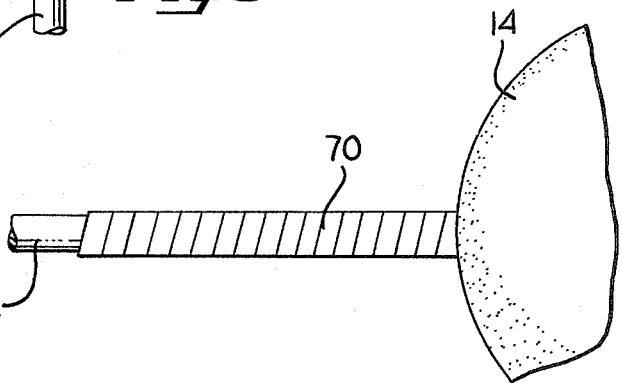
FIG. 10 is a side plan view showing a rod wrapped with an adhesive tape as a safety precaution in the event of breakage.

Lastly, a significant, although optional, safety feature of the present invention is now described with reference to FIGS. 10 and 11. This feature relates to means for restraining the end portion of rod or tube and the ball in the event the rod or tube breaks. Without restraints, a broken rod or tube could fly uncontrolled through the air, possibly striking and injuring someone nearby. The most simple restraining means contemplated by this invention is an adhesive tape 70, made of a material with a very high tensile strength, circumferentially and tightly wrapped around rod or tube 12 along its entire length as shown in FIG. 10. If the rod or tube 12 should sever anywhere along its length, the tape 70 would restrain it from flying off.

Figure 11:
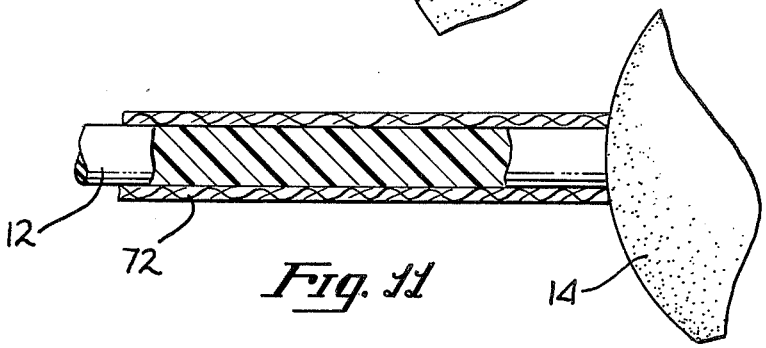
FIG. 11 is a partial cross-sectional view of a rod encased in a sheath as a safety precaution in the event of breakage.

In lieu of a wound adhesive tape 70, the rod or tube 12 may be completely covered with a tight fitting sheath 72 as shown in FIG. 11. The sheath 72 may be made of rubber, plastic material, or a woven fabic.

Although this invention has been disclosed and described with reference to particular embodiments, the principles involved are susceptible of other applications which will be apparent to persons skilled in the art. This invention, therefore, is not intended to be limited to the particular embodiments herein disclosed.

I claim:

1. A device for practicing racquet strokes comprised of:

a. a member comprising first and second arms disposed at approximately right angles to one another and having a curved portion between said arms;

b. first means for gripping said member disposed at the outer end of said first arm, said first gripping means comprising a narrow, substantially rectangular handle, the plane of said handle being substantially co-planar with the plane of said first and second arms;

c. second means for gripping said member disposed on said second arm in the vicinity of said curved portion of said member, said second gripping means being a knurled region of said second arm, and d. a ball fixedly secured to said member at the outer end of said second arm thereof, whereby, said user grips said first gripping means to practice backhand related strokes and grips said second gripping means to practice forehand-related, overhead and service strokes.

2. The device of claim 1 wherein said handle has grooves therein adapted to receive the fingers of said user's hand.

3. A device suitable for practicing racquet strokes comprised of:

a. a flexible member comprising first and second arms disposed at approximately right angles to each other and having a curved portion thereinbetween, said second arm having a knurled region at its end adjacent said curved portion, and said second arm being tapered from the vicinity of said knurled region down to its outer end;

b. a narrow, substantially rectangular handle disposed at the outer end of said first arm of said member, the plane of said handle being substantially coplanar with the plane of said first and second arms; and c. a ball fixedly secured to said outer end of said second arm, whereby, a user can practice backhand-related strokes by gripping said device by said handle in one hand and striking said ball with a racquet held in his other hand, and forehand-related, overhead and service strokes by gripping said device by said knurled region of said second arm in one hand and striking said ball with a racquet held in said other hand.

4. The device of claim 3 wherein said flexible material is a nylon tube.

5. The device of claim 3 wherein said flexible material is a nylon rod.

6. The device of claim 3 wherein said first and second arms of said member are circular in cross-section.

7. The device of claim 3 wherein said first arm of said member is elliptical in cross-section and said second arm thereof is circular in cross-section.

* * * * *